United States Patent [19]

Hackman

[11] Patent Number: 5,062,811

[45] Date of Patent: Nov. 5, 1991

[54] CAPACITIVE COUPLED CONNECTOR FOR PCB GROUNDING

[75] Inventor: John A. Hackman, Elizabethtown, Pa.

[73] Assignee: AMP Incorporated, Harrisburg, Pa.

[21] Appl. No.: 605,613

[22] Filed: Oct. 30, 1990

[51] Int. Cl.[5] ..... H01R 13/66

[52] U.S. Cl. ..... 439/620; 439/92; 439/581; 439/63

[58] Field of Search ..... 439/578–585, 439/620, 63, 816, 366

[56] References Cited

U.S. PATENT DOCUMENTS

| | | | |
|---|---|---|---|
| 4,598,961 | 7/1986 | Cohen | 339/17 C |
| 4,659,156 | 4/1987 | Johnescu et al. | 339/17 C |
| 4,690,479 | 9/1987 | Hollyday et al. | 439/97 |
| 4,741,703 | 5/1988 | Johnescu et al. | 439/63 |
| 4,759,729 | 7/1988 | Kemppainen et al. | 439/581 |
| 4,795,352 | 1/1989 | Capp et al. | 439/63 |
| 4,797,120 | 1/1989 | Ulery | 439/578 |
| 4,884,982 | 12/1989 | Fleming et al. | 439/620 |
| 4,934,960 | 5/1990 | Capp et al. | 439/620 |

*Primary Examiner*—David L. Pirlot

[57] ABSTRACT

Herein disclosed is an electrical coaxial connector for mounting on a printed circuit board, the connector shell being capacitively coupled with the board. The coupling function is accomplished using a resilient conductive clip (32) which holds electrical capacitor elements (33) in pressure contact against the shell (9) and maintains contact with connector conductive posts (31) inserted into the board. The coupling serves to drain high frequency radio-frequency voltages from the connector to the board.

6 Claims, 4 Drawing Sheets

CAPACITIVE COUPLED CONNECTOR FOR PCB GROUNDING

Each of the discussed advantages, features and objectives contributes to the use and importance of the invention.

FIELD OF THE INVENTION

The invention relates to an electrical connector for connection to a printed circuit board, and more particularly, to features of the connector providing a capacitive coupling to the circuit board and a voltage discharge path.

BACKGROUND OF THE INVENTION

U.S. Pat. No. 4,797,120 discloses a known connector for mounting to a conductive panel and comprising, an insulated signal transmitting contact, an insulated conductive shell and a coupling portion for coupling the shell to the panel. The coupling portion is a device with an electrical filter and is externally secured to an electrical connector without regard to whether the device is within the profile of the connector. U.S. Pat. No. 4,884,982 discloses a capacitive coupling including a conductive clip adapted to the outer profile of an electrical connector and providing a capacitive coupling of a conductive shell of the connector with multiple conductor paths through capacitor elements held by the clip in pressure engagement with a conductive shell of the connector; the clip further providing a voltage discharge path between the clip and the shell.

The capacitive coupling of both prior disclosures functions to isolate high frequency Radio Frequency voltages from the connector to a conductive panel; generally this is the frame or chassis of the application, e.g. a personal computer. In such an application, there generally is sufficient internal space to use the chassis for isolating electronic components so as to minimize distortion from stray electrical discharges, utilizing a conductive internal frame to isolate them. However, in more constricted applications, e.g. a laptop computer, electronic components must be placed in more concentrated arrangements, often with no conductive chassis or frame at all. It thus becomes necessary to drain high frequency RF voltages, along a drain circuit on a back side of the same circuit board on which the electronic components are mounted.

The connector of U.S. Pat. No. 4,884,982 could be modified to extend its clip arms to additional conductive post which would plug into additional circuit board apertures, thereby draining high frequency RF voltages to the circuit board. To do so would modify the connector footprint, the pattern formed on the circuit board by the connector's electrical terminals and conductive posts. Previously designed circuit boards would not be readily adaptable to accept connectors with a different footprint.

SUMMARY OF THE INVENTION

The present invention relates to a capacitive coupled connector within the family of connectors of U.S. Pat. No. 4,797,120 and U.S. Pat. No. 4,884,982 having a capacitive coupling feature. An objective of the present invention is to provide a connector that may be mounted on a circuit board and having means to couple the connector to the circuit board without modifying the connector footprint.

A feature of the invention is the conductive clip which holds electrical capacitor elements in pressure engagement against a conductive shell of the connector to provide capacitive coupling of the shell and a conductive portion of the circuit board. The clip is in contact with connector conductive posts which plug into circuit board apertures.

An advantage of grounding the connector to the circuit board upon which it is mounted is that it is unnecessary to place the connector near a metal conducting frame, or even to use a conducting frame at all. Another advantage of the invention is that by coupling through existing conductive posts, the connector footprint remains unchanged, and no circuit board redesign is required.

These and other advantages, features and objectives of the invention are disclosed by way of example from the following detailed description and accompanying drawings.

DETAILED DESCRIPTION OF THE INVENTION

Figure 1:
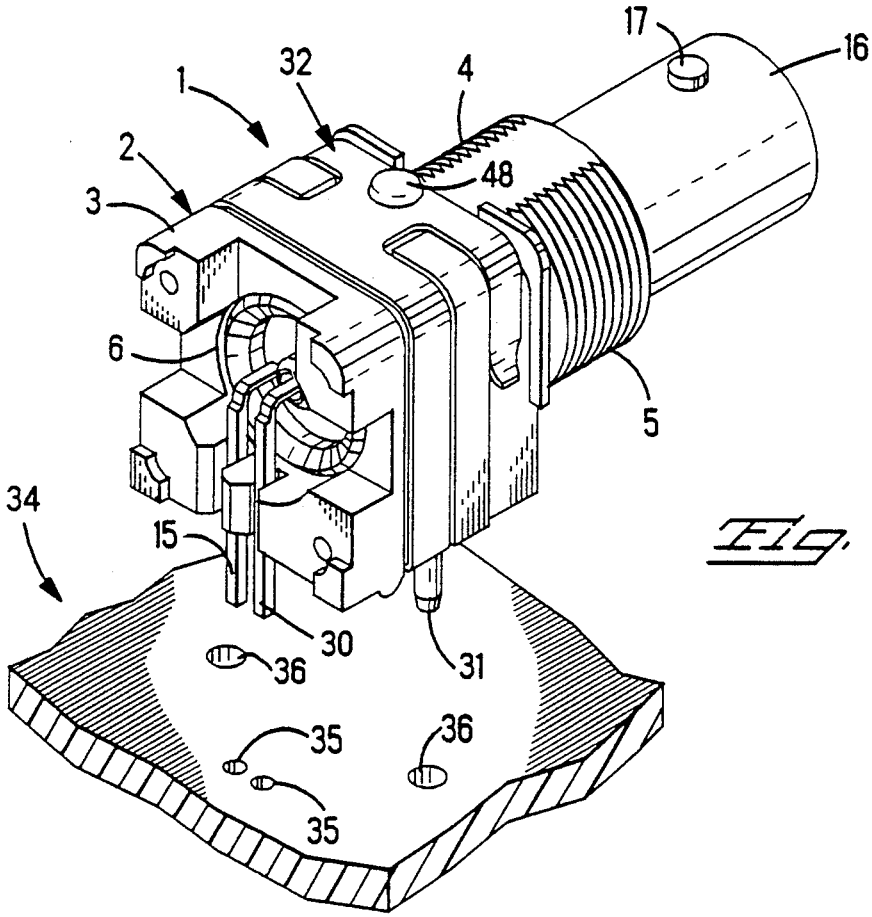
FIG. 1 is a perspective view of a connector adapted for providing a capacitive coupling to a circuit board, exploded from the board.
Figure 2:
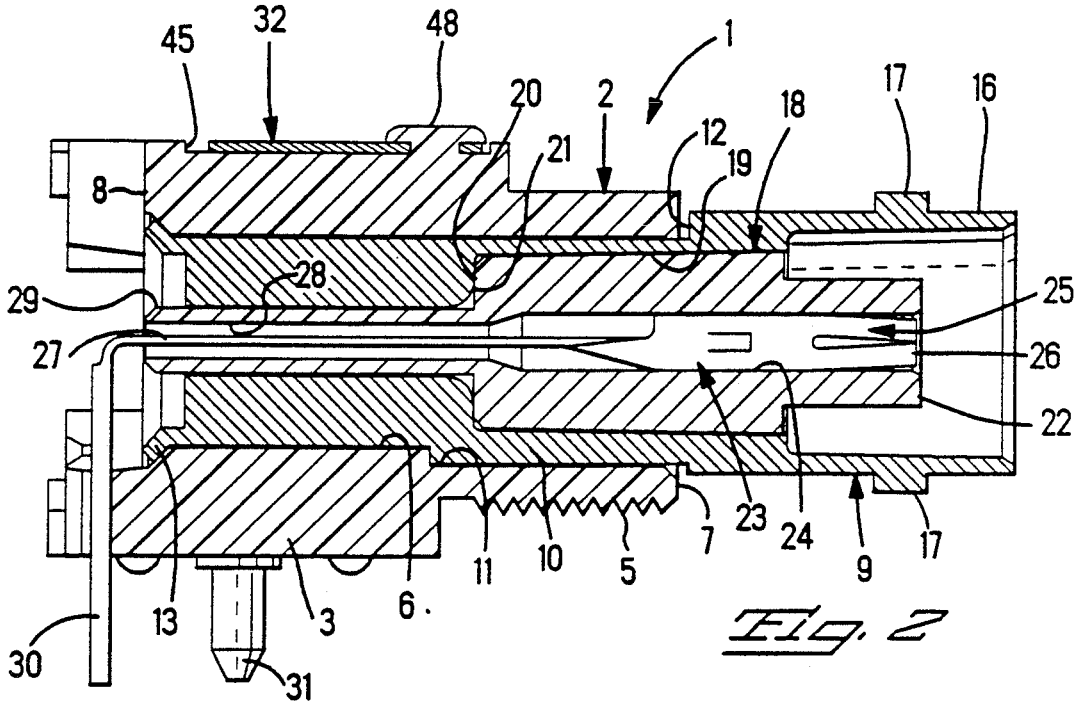
FIG. 2 is a longitudinal view in section of the connector shown in FIG. 1.
Figure 3:
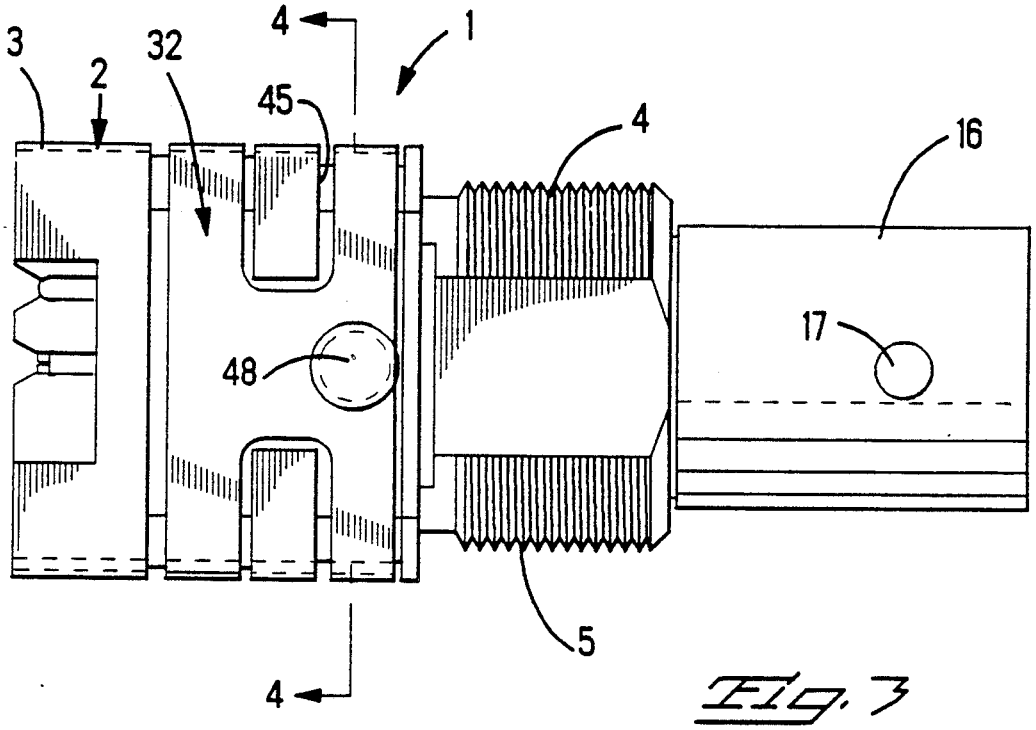
FIG. 3 is a top plan view of the connector shown in FIG. 1.

With reference to FIGS. 1, 2 and 3, an electrical connector 1 includes an insulative body 2 fabricated, for example, by molding, and includes an enlarged portion 3, the outer dimensions of which are of block rectangular profile, and a unitary cylindrical portion 4 with external threads 5. A hollow interior portion 6 extends axially through the portions 3 and 4, and through a front end 7 of the portion 4, and through a rear end 8 of the portion 3.

A conductive, stepped cylindrical outer shell 9 is within the hollow interior portion 6. An external projecting key 10 of the shell 9 extends along a keyway 11 in the body 2 extending from the front end 7. Relative movement of the shell 9 is prevented by a rear facing shoulder 12 of the shell 9 that faces the front end 7, and by a thin flange 13 of a rear end of the shell 9 outwardly flared, after insertion into the hollow interior portion 6, to engage against a flared rear of the interior portion 6. An elongated inner electrical terminal 15 imbedded in the shell 9 projects for pluggable receipt in a corresponding aperture 35 of a printed circuit board, PCB, 34.

A disconnect coupling portion 16 of a front portion of the shell 9 projects axially forward of the body 2 and is provided with bayonet coupling prongs 17 for disconnect coupling with a complementary connector, not shown.

A hollow insulative liner 18 for the shell 9 is known as a dielectric and extends within an axial, stepped cylindrical passage 19 concentrically of the shell 9. An external step shoulder 20 of the liner 18 engages an interior, front facing, step shoulder 21 of the shell 9. A forward portion 22 of the liner 18 is of reduced diameter and projects concentrically into the disconnect coupling portion 16 of the shell 9.

A conductive electrical contact 23, known as a center contact, of stamped and formed metal strip extends concentrically within the liner 18 along a stepped passage 24 of the liner 18. A unitary, disconnect contact portion 25 includes a hollow cylindrical electrical receptacle formed by bending the strip into a hollow cylindrical shape. An open front end 26 of the contact portion 25 faces forward and is concentrically within the liner 18. An elongated portion 27 of the contact 23 extends concentrically along a reduced diameter portion 28 of the passage 24 and projects beyond a rear end 29 of the liner 18 to provide an electrical terminal 30 for pluggable receipt in a corresponding aperture 35 of printed circuit board 34. Conductive posts 31 are imbedded in the body 2 and extend in the same direction as that of the terminal 30 for pluggable receipt into additional PCB apertures 36.

Figure 4:
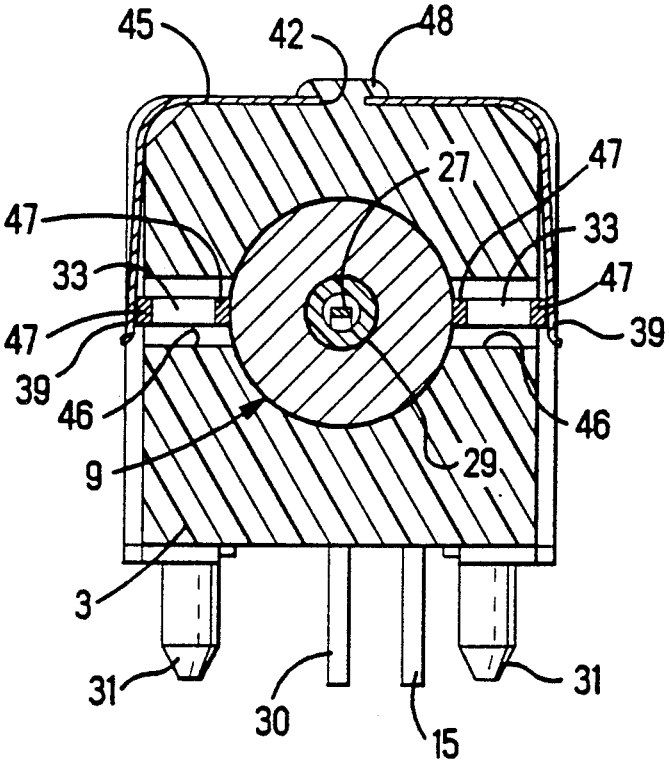
FIG. 4 is a section view taken along the line 4—4 of FIG. 3.

The connector 1 is a BNC type coaxial connector and has an exterior profile of dimensions the same as that of a known BNC type connector. The connector 1 is adapted with a conductive clip 32 and multiple capacitor elements 33, FIG. 4, to provide a capacitive coupling of the shell 9 with the printed circuit board 34. The capacitive coupling will discharge a voltage from the shell 6 to the board 34 and will allow a voltage of the shell 9 to be capacitive coupled with a corresponding voltage of the board 34.

Figure 5:
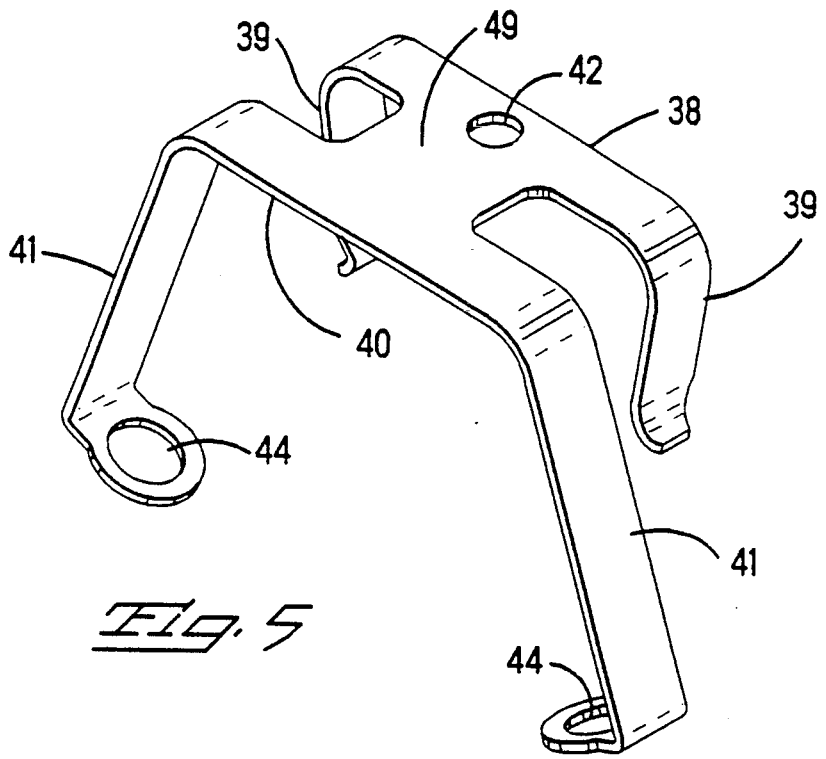
FIG. 5 is a perspective view of a clip shown in an unassembled condition.
Figure 6:
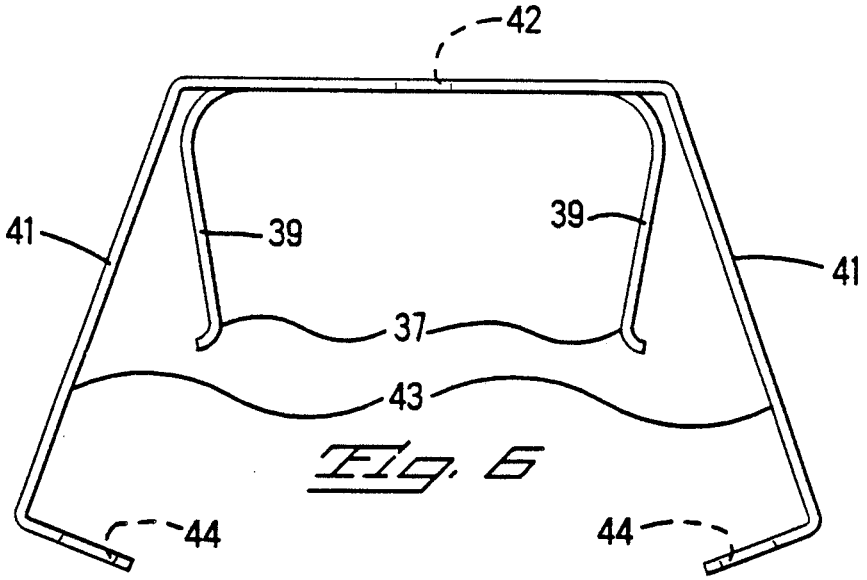
FIG. 6 is a front view of the clip shown in FIG. 5.
Figure 7:
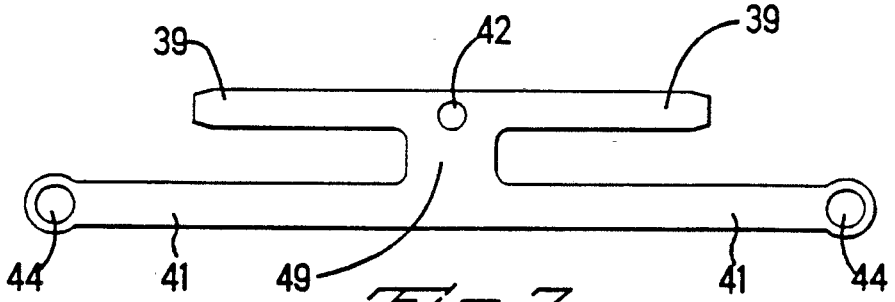
FIG. 7 is a top plan view of a flat form of the clip shown in FIG. 5.

According to FIGS. 5–7, the clip 32 is spring resilient, and is fabricated from a stamped and formed, unitary metal strip of relatively thin thickness. The clip 32 includes a front curvilinear yoke 37 having a bight 38 and spaced apart arms 39 inclined toward each other and a rear curvilinear yoke 43 having a bight 40 and spaced apart arms 41 inclined away from each other, the front and rear yokes connected by a middle portion 49. An opening 42 through the front bight 38 and openings 44 through the rear arms 41 extend through the thickness.

The block rectangular portion 3 is provided with an external recess 45 inset into the outer profile of the connector 1. The recess 45 is shaped to receive the outer edges of the clip 32 and to inset the clip 32 within the outer profile A corresponding, capacitor receiving, cavity 46 extends into the block rectangular portion 3 and intersects the recess 45 and an exterior of the shell 9. A corresponding capacitor element 33 of known, commercially available form is assembled in a corresponding cavity 46, and has integral conductive contacts 47, respectively engaged against the shell 9 and against the clip 32.

Figure 8:
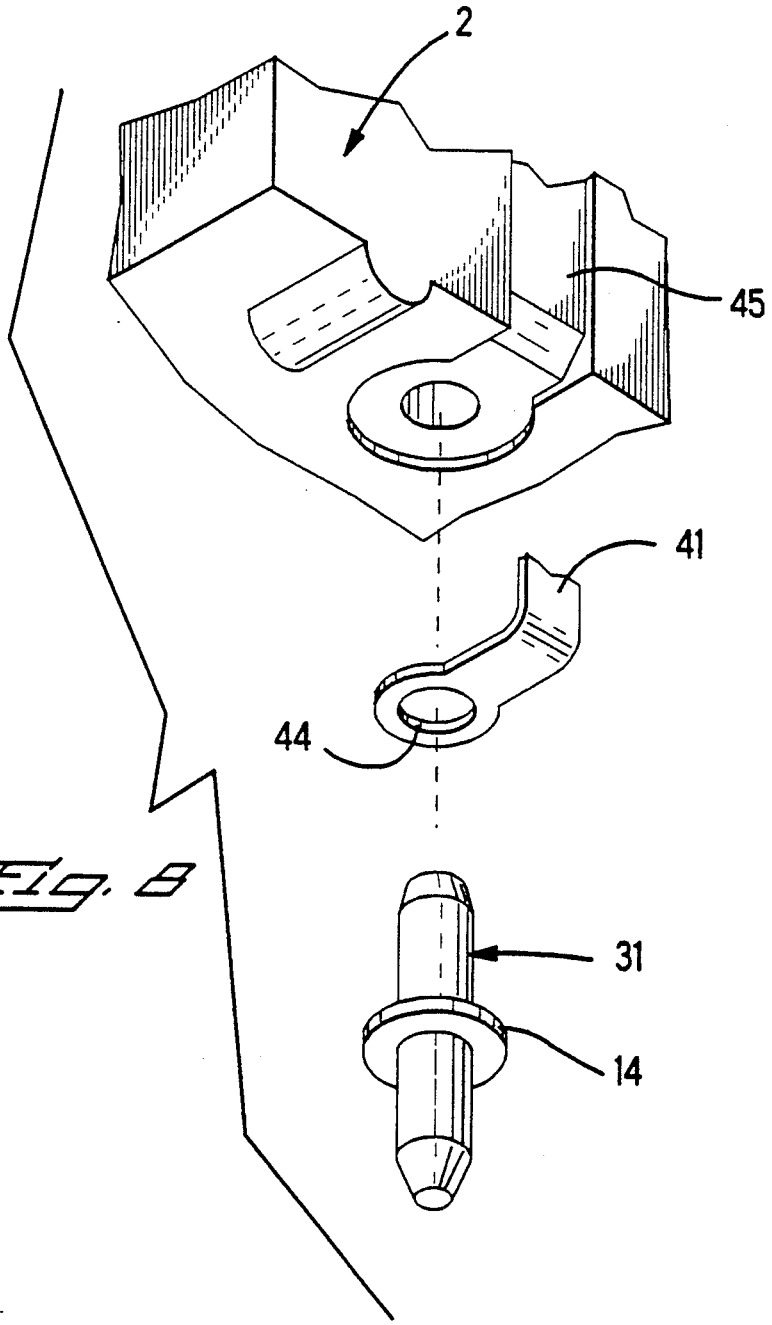
FIG. 8 is an exploded sectional view of the connector shown in FIG. 1.

The body 2 has a peg 48 projecting from the bottom of the recess 45 and through the opening 42 in the bight 38 of the clip 32. An enlarged rivet head, FIG. 2, is formed on the peg 48 by the application of heat and pressure to overlie and retain the clip 32. Rear clip arms 41 are deflected resiliently towards the connector body 2 until openings 44 are aligned with openings for the conductive posts 31. Rear clip arms 41 fit completely within external recess 45. As shown in FIG. 8, the conductive posts 31 are then inserted through the openings 44 into the connector body 2, held in place by interference fits Flange 14 on the conductive posts 31 limits the depth of insertion. Resilient spring pressure maintains contact between posts 31 and edges of the openings 44 of the arms 41.

Each corresponding capacitor element 33 projects from a corresponding cavity 46 into the recess 45, and urges against a corresponding arm 39 of the clip 32, tending to deflect the arm 39 pivotally away from the other arm 39. In turn, the corresponding arm 39 urges a corresponding capacitor element 33 toward the shell 9 by a spring bias caused by deflection of the arm 39. Thereby, each corresponding capacitor element 33 is held by the clip 32 in pressure engagement with the shell 9. Further thereby, the clip 32 exerts a spring force to maintain pressure engagement of each corresponding capacitor element 33 with the shell 9 and with the clip 32.

I claim:

1. An electrical connector form mounting to a printed circuit board, said connector comprising:

an insulated inner signal transmittal contact;

an insulated outer conductive shell encircling the contact;

a conductive post insulated from the shell and adapted for insertion into the board;

an electric capacitor element held in contact with the shell; and a conductive clip adapted to engage the capacitor element;

said clip being maintained in contact with the post to establish a capacitive electrical coupling of the shell, through the capacitor element and the post, to the board.

2. An electrical connector as recited in claim 1, wherein the connector posts and contacts establish a footprint identical to that of a known coaxial connector.

3. An electrical connector as recited in claim 1, wherein the clip is inset within an outer profile of the connector.

4. An electrical connector as recited in claim 1, wherein the clip holds the capacitive elements in pressure contact with the shell.

5. An electrical connector as recited in claim 1, wherein the clip is kept in pressure contact against the posts.

6. A connector as recited in claim 5 wherein the clip is spring resilient, having an arm with an opening through which the conductive post is inserted, contact between the post and edges of the opening being maintained by resilient spring pressure.

* * * * *

UNITED STATES PATENT AND TRADEMARK OFFICE

CERTIFICATE OF CORRECTION

PATENT NO. : 5,062,811

DATED : November 5, 1991

INVENTOR(S) : John A. Hackman

It is certified that error appears in the above-identified patent and that said Letters Patent is hereby corrected as shown below:

Column 4, line 28, replace "form" with --for--;
Column 4, line 35, replace "electric" with --electrical--.

Signed and Sealed this

Fourth Day of May, 1993

*Attest:*

Michael K. Kirk

MICHAEL K. KIRK

*Attesting Officer*

*Acting Commissioner of Patents and Trademarks*